US005401020A

United States Patent [19]

Dutton

[11] Patent Number: 5,401,020

[45] Date of Patent: Mar. 28, 1995

[54] DEVICE FOR SIMULATING BREAKING FOOTBALL TACKLES

[76] Inventor: Craig E. Dutton, 2627 N. Graham Cir., Akron, Ohio 44312

[21] Appl. No.: 96,032

[22] Filed: Jul. 22, 1993

[51] Int. Cl.[6] ..... A63B 67/00

[52] U.S. Cl. ..... 273/55 R

[58] Field of Search ..... 273/55 R

[56] References Cited

U.S. PATENT DOCUMENTS 4,059,268 11/1977 Forrest ..... 273/55 R 4,134,586 1/1979 King ..... 273/55 R

*Primary Examiner*—Theatrice Brown

*Attorney, Agent, or Firm*—Roger D. Emerson

[57] ABSTRACT

A football training device to train football running backs to break tackles simulates the arms of tacklers by resisting movement of the football player's foot upwardly and downwardly through target apertures. The device includes a frame with a series of target apertures configured in two parallel rows. The football trainer runs through the device by stepping into the apertures. As he does so, elastomeric sheet affixed to the top of the frame resists movement of the football player's foot downwardly into the aperture and upwardly out of the aperture, thereby simulating the action of the arms of would-be tacklers.

3 Claims, 4 Drawing Sheets

DEVICE FOR SIMULATING BREAKING FOOTBALL TACKLES

BACKGROUND OF THE INVENTION

1. Field of Invention

This invention pertains to the art of football training aids, and more particularly to football training aid which simulates tackling to aid a running back in breaking such tackles, even more specifically to such an aid which provides resisting means to resist movement of the football player both downwardly and upwardly.

2. Description of Related Art

Football training aids such as tackling dummies and blocking slits have long been utilized to assist football players in preparing for football games. One such device is a series of automobile tires chained together. The automobile tires are configured into two parallel rows with the tires being slightly offset so that the football player puts his left foot into the first tire in the left row, then his right foot into the first tire in the right row, then his left foot into the second tire in the left row, etc. This drill helps the football player practice foot placement and lifting his knees upwardly as he runs. This procedure can be of assistance in running through defensive lines and maintaining one's upright stance. However, this training aid provides no means to simulate the resisting movement as would be supplied by the actual tackler during the game.

The present invention presents a new and improved football training aid which is simple in design, effective in use, and overcomes the foregoing difficulties in others while providing better and more advantageous overall results.

SUMMARY OF THE INVENTION

In accordance with the present invention, a new and improved football training aid is provided which is adapted to simulate the experience of being tackled.

More particularly, in accordance with the invention, the device includes a frame having generally horizontal members forming target apertures for receiving the feet of a football player. Legs extend downwardly from the horizontal members and suspend the horizontal members parallel above the ground. The target apertures are juxtaposed relative to one another so that a football player can step through the apertures while running over the device. Resisting means for resisting movement of the football player's feet includes a sheet of resilient material which is affixed to the top surface of the frame. The resisting means has slits cut into the resilient material over the target apertures. The slits form hinged extensions which resilient reflect downwardly upon the insertion of the football players feet through the aperture and resiliently upward upon upward movement of the football players feet out of the apertures.

One advantage of the present invention is a football training aid which can be used to simulate tackles and assist the football player in breaking such tackles.

Another advantage of the invention is the provision of a means to resist movement of the football players feet. This simulates the actual tackling and breaking tackling experience more completely than other training aids available.

Still another advantage of the invention is the provision of a low cost, durable training? device which can be advantageously used by football players to prepare for football games.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DESCRIPTION OF THE PREFERRED EMBODIMENT

Figure 1:
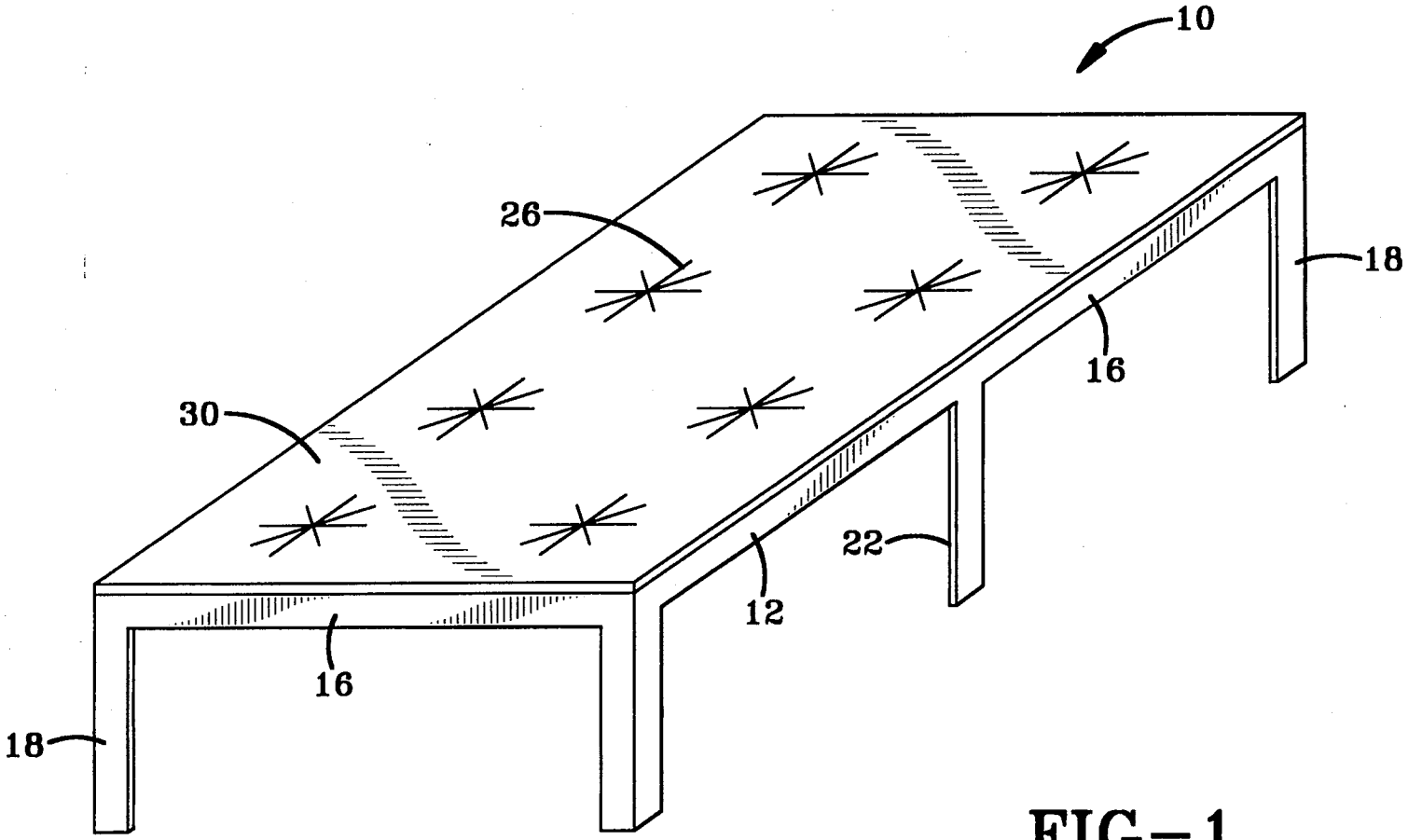
FIG. 1 is a perspective view of a device according to the invention.

Referring now to the drawings wherein the showings are for purposes of illustrating a preferred embodiment of the invention only and not for purposes of limiting same, FIG. 1 shows a football training device 10 according to the invention. With reference to FIGS. 1–4, the device 10 includes a frame 12 which includes a plurality of horizontal member 16 and legs 18. The legs 18 are positioned at the corners of the frame 12. Additional supporting legs 22 may be placed in the middle sections of the device 10. In a preferred embodiment, the legs 18 are made of 1½ inch angle iron while the horizontal members 16 are made of similarly sized flat stock. In the preferred embodiment, the legs 18 are 13¾ inches long, placing the horizontal members 16 about 13 inches over the ground.

Figure 2:
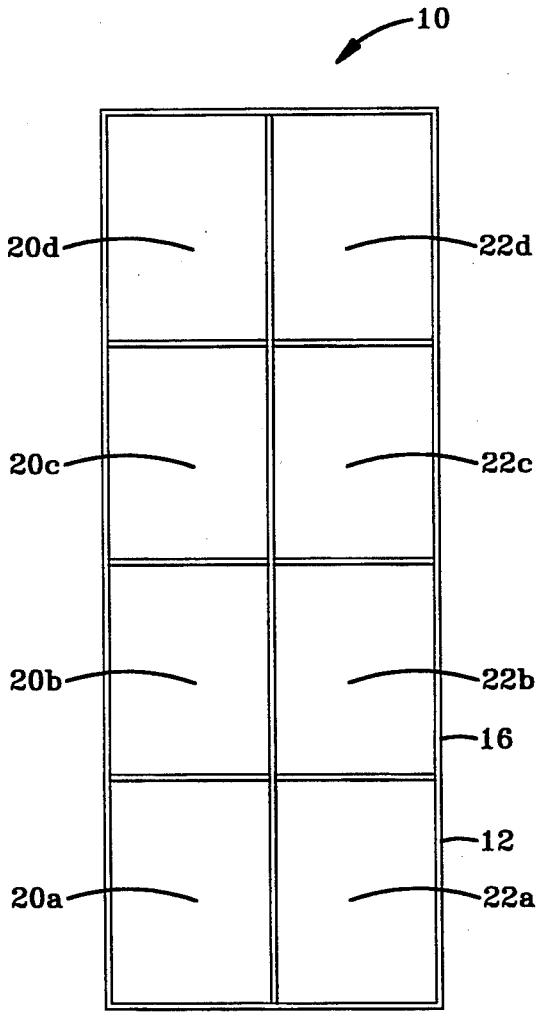
FIG. 2 is a top view of the device of FIG. 1 with the elastomeric sheet removed to show the frame.

With reference to FIG. 2, the horizontal members 16 are configured so that a plurality of target apertures 20,22. In the preferred embodiment, the target aperatures are 23 inches by 17¼ inches. The overall length of the frame 12 is 92⅜ inches by a width of 35½ inches. A typical application, as the football player approaches the device 10 from the bottom of the page toward the top of the page, his left foot would enter target aperture 20 while his right foot would enter target aperture **22*b* with his left foot withdrawing from aperture 20*a* and then entering aperture 20*c* while his right foot exists aperture 22*b* and enters aperture 22*d***.

With reference to FIG. 1, a resisting means for resisting movement of the feet of the football player through the target apertures 20,22 is shown. In the preferred embodiment shown in FIG. 1, the resisting means is a sheet 30 of elastomeric material, such as a conveyor belt. In the preferred embodiment, the sheet 30 is 3/16 of an inch thick, 37½ inches wide, and 94 inches long. The sheet 30 is slightly larger than the frame 12 to protect the football players from possible injury by striking their legs against the frame 12. While the present embodiment is configured as described above, it is foreseeable that other resisting means could be easily devised which perform a similar function of resisting movement of the football player's foot downwardly and/or upwardly through the target aperture 20,22.

Figure 7:
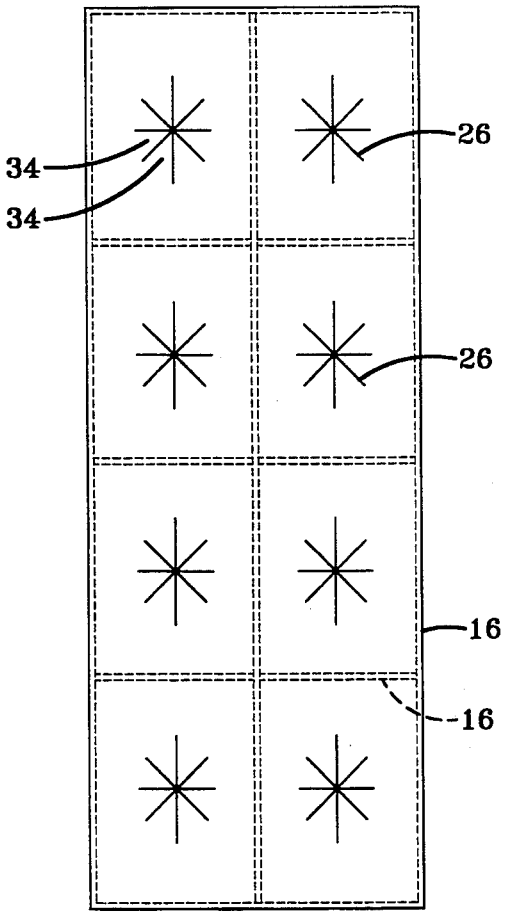
Figure 3:
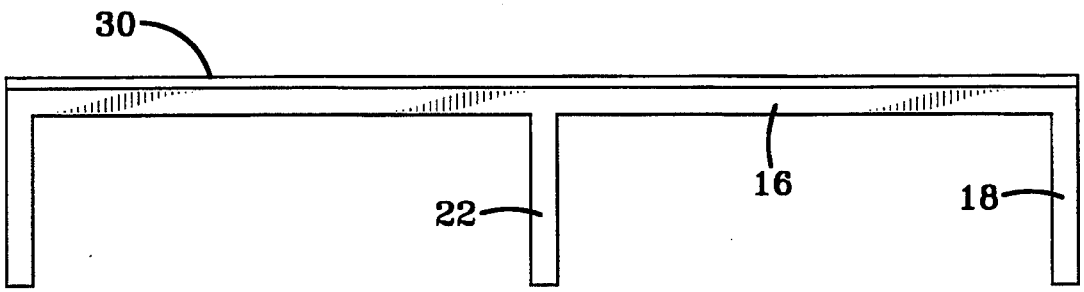
FIG. 3 is a side elevational view of the device shown in FIG. 1.
Figure 4:
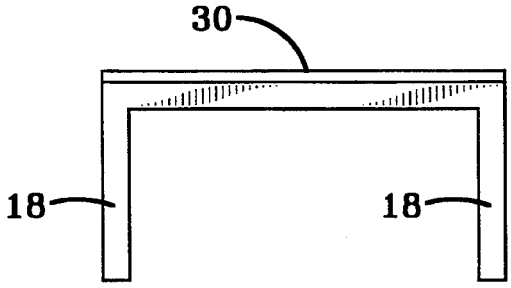
FIG. 4 is an end view of the device shown in FIG. 1.

With reference to FIG. 7, each target aperture 20,22 features slits 26. Although the slits 26 could be configured in a variety of ways, the presently configured configuration includes a series of four slits separated by angles of 45 degrees. The slits 26 create eight extensions 34 which perform the important function of resisting movement of the football player's foot.

Figure 5:
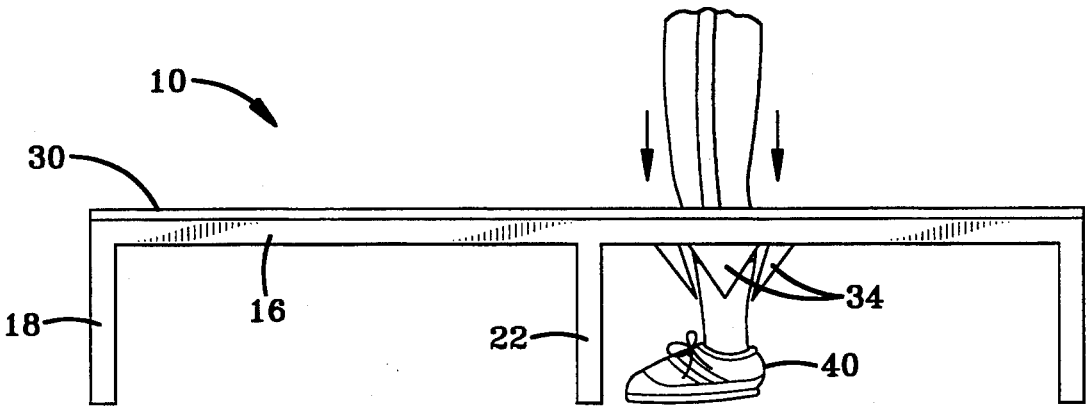
FIG. 5 is a side view of a football player's foot entering downwardly into a target aperture of the invention.
Figure 6:
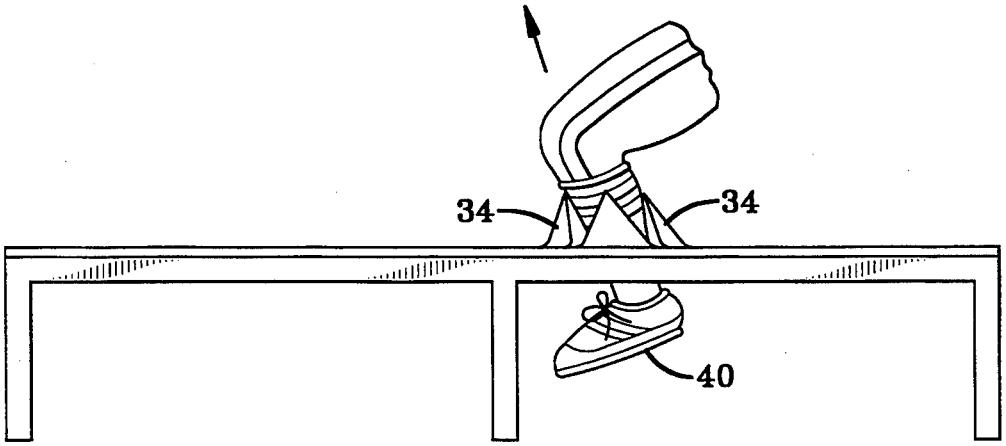
FIG. 6 is a side view of the football player's foot moving upwardly out of a target aperture of the invention; and, FIG. 7 is a top view of the device of FIG. 1 with the elastomeric sheet attached and the frame shown in dotted lines, showing slits over the target apertures.

With reference to FIGS. 5 and 6, the operation of the device 10 will be schematically portrayed. With reference to FIG. 5, the football player's foot 40 has just passed downwardly through the target aperture 20,22. The extensions 34 have been resiliently reflected downwardly under the weight of the football player. Although the extensions 34 have deflected downwardly, they have resisted movement of the football player' foot 40 through the target aperture 20,22. With reference to FIG. 6, the football player is shown in the process of pulling his foot 40 upwardly out of the device 10 and back through the target aperture 20,22. The extensions 34 have resiliently deflected upwardly and continue to resist movement by the football player's foot 40 upwardly through the target aperture 20,22. Depending upon the modulus of elasticity of the sheet 30 and the configuration of the slits 26, varying amounts of resistance can be presented to the football player's foot 40.

The invention has been described with reference to a preferred embodiment. Obviously, modifications and alterations will occur to others upon a reading and understanding of this detailed specification. It is intended to include all such modifications and alterations insofar as they come within the scope of the appended claims or the equivalence thereof.

Having thus described the invention, it is now claimed:

1. A device for simulating a football tackle to aid in the training football running backs, comprising:

a frame supported on a support surface, said frame having generally horizontal members forming at least one horizontal target aperture for receiving a foot of a football player, said aperture being positioned a predetermined distance above said support surface; and, upward resisting means for resisting upward movement of a foot through said target aperture, said upward resisting means being a sheet of resilient material having slits cut therein and extending across said at least one target aperture.

2. The device of claim 1 wherein said slits form two sides of a triangularly shaped hinged extension, a third side of said hinged extension forming a hinge, said hinged extensions resiliently deflecting downwardly upon insertion of said first foot through said first aperture and resiliently deflecting upwardly upon upward movement of said foot.

3. A football training device to train football running backs to break tackles by opposing players, said device comprising:

a frame, said frame having generally horizontal members forming two rows of left and right target apertures for receiving the respective left and right feet of a football player, said frame further comprising legs extending downwardly from said horizontal members and suspending said horizontal members above the ground; and, resisting means for resisting movement of said feet of said football player through said target apertures, said resisting means being a sheet of horizontally extending resilient material having slits cut into said resilient material and extending across said target apertures, said slits forming two sides of a triangularly shaped extension, a third side of each of said extensions forming a hinge, said hinged extensions resiliently deflecting downwardly upon insertion of said feet through said apertures and resiliently deflecting upwardly upon upward movement of said feet.

* * * * *